US007431081B2

(12) United States Patent
Stave

(10) Patent No.: US 7,431,081 B2
(45) Date of Patent: Oct. 7, 2008

(54) DEVICE FOR REMOVAL AND FILTRATION OF DRILLING FLUID

(76) Inventor: Roger Stave, Valahøgda 9, N-5355 Knarvik (NO)

( * ) Notice: Subject to any disclaimer, the term of this patent is extended or adjusted under 35 U.S.C. 154(b) by 0 days.

(21) Appl. No.: 10/580,137

(22) PCT Filed: Nov. 17, 2004

(86) PCT No.: PCT/NO2004/000353

§ 371 (c)(1),
(2), (4) Date: Apr. 3, 2007

(87) PCT Pub. No.: WO2005/049958

PCT Pub. Date: Jun. 2, 2005

(65) Prior Publication Data

US 2007/0215218 A1 Sep. 20, 2007

(30) Foreign Application Priority Data

Nov. 21, 2003 (NO) ..... 20035172

(51) Int. Cl.
*F24D 11/00* (2006.01)
*E21B 21/06* (2006.01)
*C09K 8/02* (2006.01)

(52) U.S. Cl. ..... 166/236; 166/357; 175/66; 175/206; 210/314; 210/435

(58) Field of Classification Search ..... 166/234–236, 166/357; 175/66, 206; 210/314, 435, 446, 210/498
See application file for complete search history.

(56) References Cited

U.S. PATENT DOCUMENTS 3,608,630 A * 9/1971 Wooden et al. ..... 166/357
3,880,762 A * 4/1975 Wise ..... 210/460
4,149,603 A 4/1979 Arnold
4,410,425 A 10/1983 Gardes
4,495,073 A * 1/1985 Beimgraben ..... 210/448
4,599,172 A * 7/1986 Gardes ..... 210/314
4,790,933 A * 12/1988 Quigley et al. ..... 210/96.1
5,794,722 A * 8/1998 Armstrong et al. ..... 175/66
6,062,313 A * 5/2000 Moore ..... 166/357
6,216,799 B1 * 4/2001 Gonzalez ..... 175/5
6,227,303 B1 * 5/2001 Jones ..... 166/378

(Continued)

FOREIGN PATENT DOCUMENTS

EP 0136369 A1 4/1985

*Primary Examiner*—Thomas A Beach
(74) *Attorney, Agent, or Firm*—Abelman, Frayne & Schwab

(57) ABSTRACT

The invention relates to a device for removal and filtration of drilling fluid at top hole drilling, where a suction module (10) comprises an extended, pipe-formed body (30), open at the top and which is arranged to an ocean-bottom penetrating pipe, through which a drill stem is led for drilling of the top hole, and where the pipe-formed body (30) comprises at least one outlet passage (32) in the pipe wall for export of return drilling fluid from the bore hole to a pump module (12). The invention is characterized in that the pipe-formed body (30) comprises a filtration device with through openings, where the mentioned openings are arranged to let through, to at least one outlet passage (32), return drilling fluid containing suspended material, such as swelling clay and stones, having a size that is less that the diameter of the inlet pipe of the pump or the openings of the pump.

19 Claims, 5 Drawing Sheets

U.S. PATENT DOCUMENTS 6,263,970 B1 7/2001 Blanchet
6,345,672 B1 * 2/2002 Dietzen ..... 175/66
6,352,111 B1 * 3/2002 Bode et al. ..... 166/265
6,598,685 B1 * 7/2003 Mashburn ..... 175/57
6,745,851 B1 * 6/2004 Edvardsen ..... 175/5
6,976,546 B2 * 12/2005 Herst ..... 175/57

* cited by examiner

SECTION A-A

DEVICE FOR REMOVAL AND FILTRATION OF DRILLING FLUID

The present invention relates to a device for removal of drilling fluid at top hole drilling, where a suction module comprises an extended pipe-formed body that is open at the top and which is arranged to an ocean-bottom penetrating pipe, through which is fed a drill stem for drilling of the top hole, and where the pipe-formed body comprises at least one outlet passage in the pipe wall for export of return drilling fluid from the bore hole to a pump module.

In connection with drilling operations (top hole) offshore, there are regions where the geological conditions result in that in many areas the formation is such that top holes must be drilled with an expensive, water-based drilling fluid, or a synthetic drilling fluid, for example KCL/Glycol drilling mud. Such drilling fluid has a typical cost of 1500-2000 NOK/$m^3$ and up to 10 000 $m^3$ can be needed for a single top hole. In addition, there are large logistics costs as these amounts of fluid are used during a period as short as 48 hours and must often be transported large distances.

Therefore, it is a wish to try to reduce this consumption of costly drilling fluid in that the drilling fluid is recycled.

The present invention, which can be called a suction module (SMO) or a collection module, has a suction chamber to which the suction pipe of the pump is connected. This can be called a "particle trap/gumbo trap" to prevent that the suction pipe is blocked during drilling in swelling clay. The advantage with this solution is that large stones (boulders) and clumps of swelling clay (gumbo) can be pumped over the top of the SMO without the suction pipe of the pump becoming blocked, with the subsequent stop of the drilling operation. The particle trap is equipped with filtration equipment that prevents large particles from entering the pump and damaging or possibly blocking it. The filtration equipment has preferably openings that are adjusted to the internal openings of the pump, typically 5-8 cm. During drilling, the capacity of the pump can be regulated so that a plug/a volume of drilling fluid is in the SMO, or slightly less than what comes up from the drill hole can be pumped so that there is a small overflow over the top of the SMO all the time. In this way, 80-90% of the drilling fluid can be recovered without the mixing in of seawater. At failure of the pump the drilling operation can continue as usual with discharge to the sea ("pump and dump").

The SMO can be used on "single slot" wells, i.e. detached production wells or exploration wells, as well as on templates with several wells.

The present invention can be used in connection with solutions that are described in the applicants own Norwegian patents, NO 308.043 and NO 312.915, either as a replacement for the solutions described therein or in combination with the described solutions.

From known technology, U.S. Pat. No. 4,149,603 can be pointed out among others. This system shows a solution where use of a riser is eliminated at drilling operations under water. The system comprises a pump which can be connected to the upper part of an underwater drilling hole and has a lower part with an inlet and an upwardly extending wall which cooperates with the lower part, and also means to prevent water coming in contact with the upper part of the cuttings only, as the cuttings pass upwards from the lower inlet. The cuttings are further transported to the surface with the help of a pump, via a pipe.

The aim of the present invention is to provide a solution which transports return drilling fluid away from a well that is drilled at top hole drilling, and also that any drilling fluid that is used in the drilling can be recycled to be used in the same drill hole or in another drill hole. It is also an aim to provide a solution that results in drilling fluid, which is delivered to a pump, containing particles that do not cause any damage to the pump.

This aim is obtained with a device according to the invention, and which is characterised by the independent claim 1, in that a pipe-formed body of the suction module comprises a filtration device with through openings, where the mentioned openings are arranged to let through to at least one outlet passage, return drilling fluid containing dispersed material, such as swelling clay and stones, of a size that is less that the diameter of the inlet pipe of the pump or the openings of the pump.

Preferred embodiments are characterised by the dependent claims 2-15.

For example, the filtration device can comprise an inner, extended, perforated plate body, where at least one annular space or parts of an annular space, which is closed in the top and/or in the bottom, is provided between the inner pipe wall of the pipe-formed body and the inner perforated plate body. The annular space can extend in the whole, or parts, of the longitudinal direction and/or circumference of the pipe-formed body. Furthermore, the extended, perforated plate body can be in the form of a pipe.

At least one outlet passage in the mentioned pipe wall can be connected to the suction pipe of the pump, or a number of outlet passages can be arranged mutually spaced apart radially around the pipe wall, where the outlet passages are connected to the suction pipe of the pump. At least one of the outlet passages in the mentioned pipe wall can be connected to a suction manifold, and the suction pipe of the pump can be connected to the suction manifold. The suction manifold can comprise a number of outlets with suction connection for the pump.

In a preferred embodiment, the suction module can comprise a lifting hoop or be shaped for connection of a lifting tool (Running Tool) so that the derrick of the drilling rig can be used for the setting out and taking up again of the SMO from the sea bottom.

The upper part of the pipe-formed body is preferably arranged to contain the return drilling fluid, such as drilling mud and cuttings, that is not led out to the pump module, and where the volume of the mentioned drilling fluid stands as a "plug" above the outlet for the suction pipe and is arranged to seal against the drill stem. The level of return fluid in the pipe-formed body can be adjusted by regulating the capacity of the pump.

For monitoring, the suction module can comprise a camera and/or a sonar for monitoring of the level of drilling fluid, i.e. the "plug" of return fluid, in the pipe-formed body and monitoring signals can be sent to an operator for adjusting the pump capacity, and/or the suction module can comprise measuring equipment for monitoring of the level of drilling fluid, and that monitoring signals are sent to an operator, or directly to the pump for regulation of the capacity of the pump.

The suction module is preferably arranged to a base plate penetrating the ocean bottom, such as a spudding-in base or a template or the like.

Furthermore, in an alternative embodiment the suction module and pump module can be integrated into each other.

The invention shall now be described in more detail with reference to the enclosed figures, in which.

Figure 4:
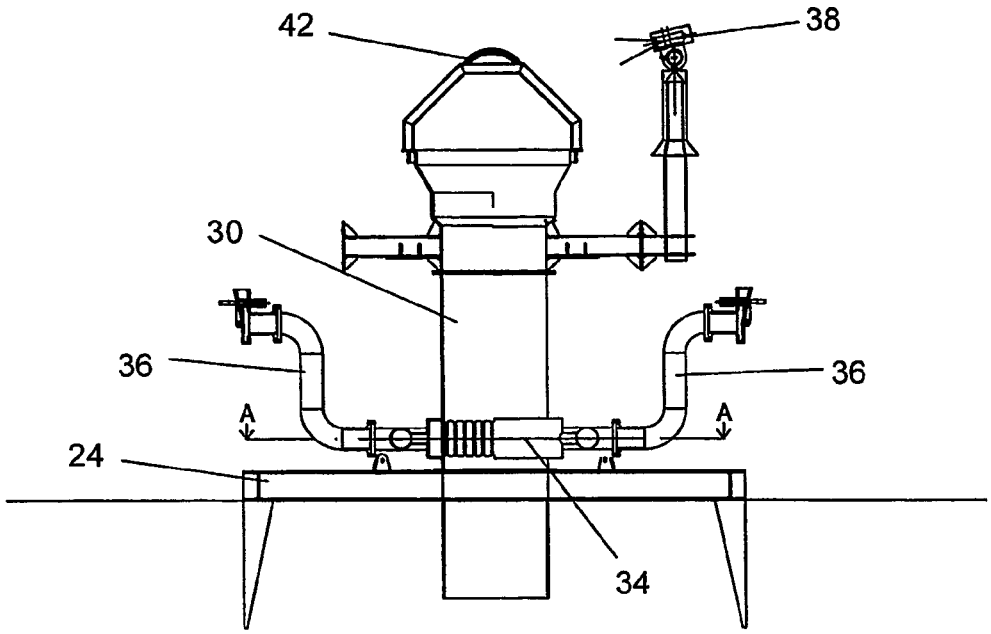
FIG. 4 shows a second embodiment example of a suction module with a device according to the present invention.
Figure 4A:
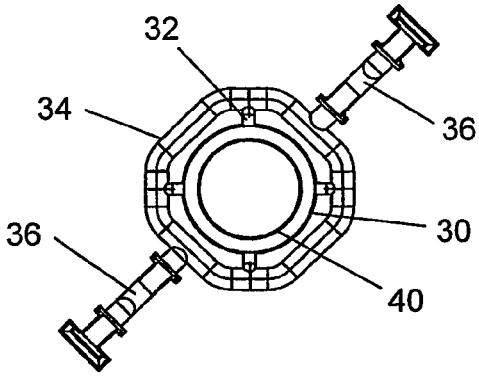

FIG. 4*a* shows a crosswise section along the line A-A in FIG. 4.

Figure 4B:
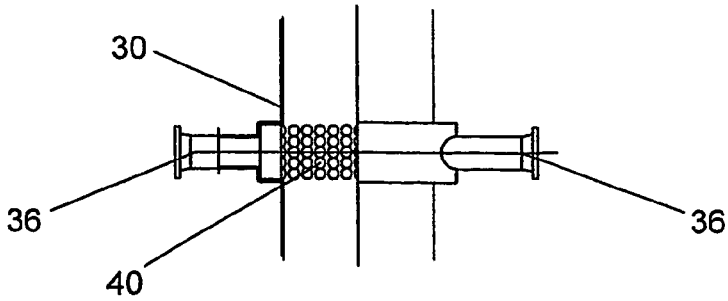

FIG. 4*b* shows a partially longitudinal section, in an area corresponding to that shown in FIG. 4*a*.

Figure 5:
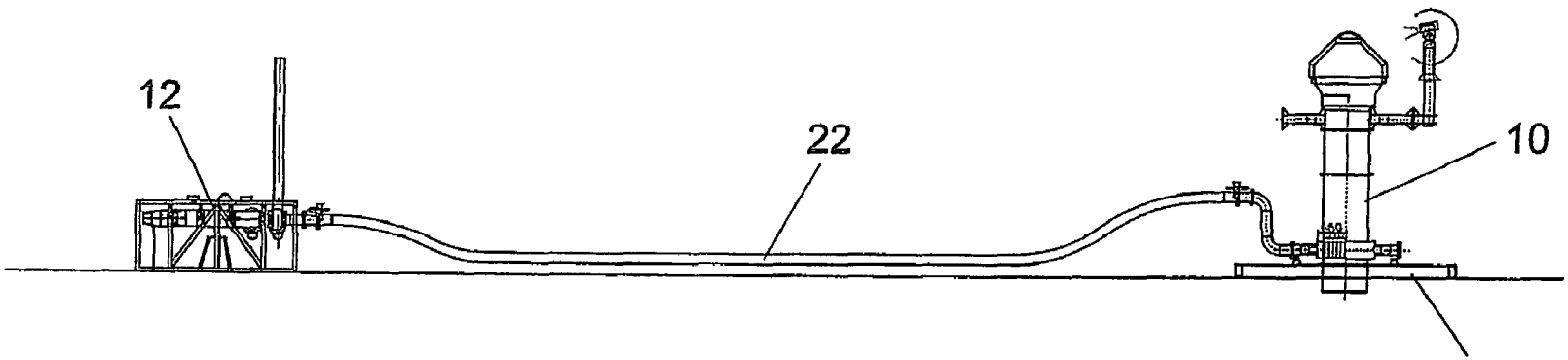

FIG. 5 shows an example of a suction module and a pump placed on the ocean bottom.

Figure 1:
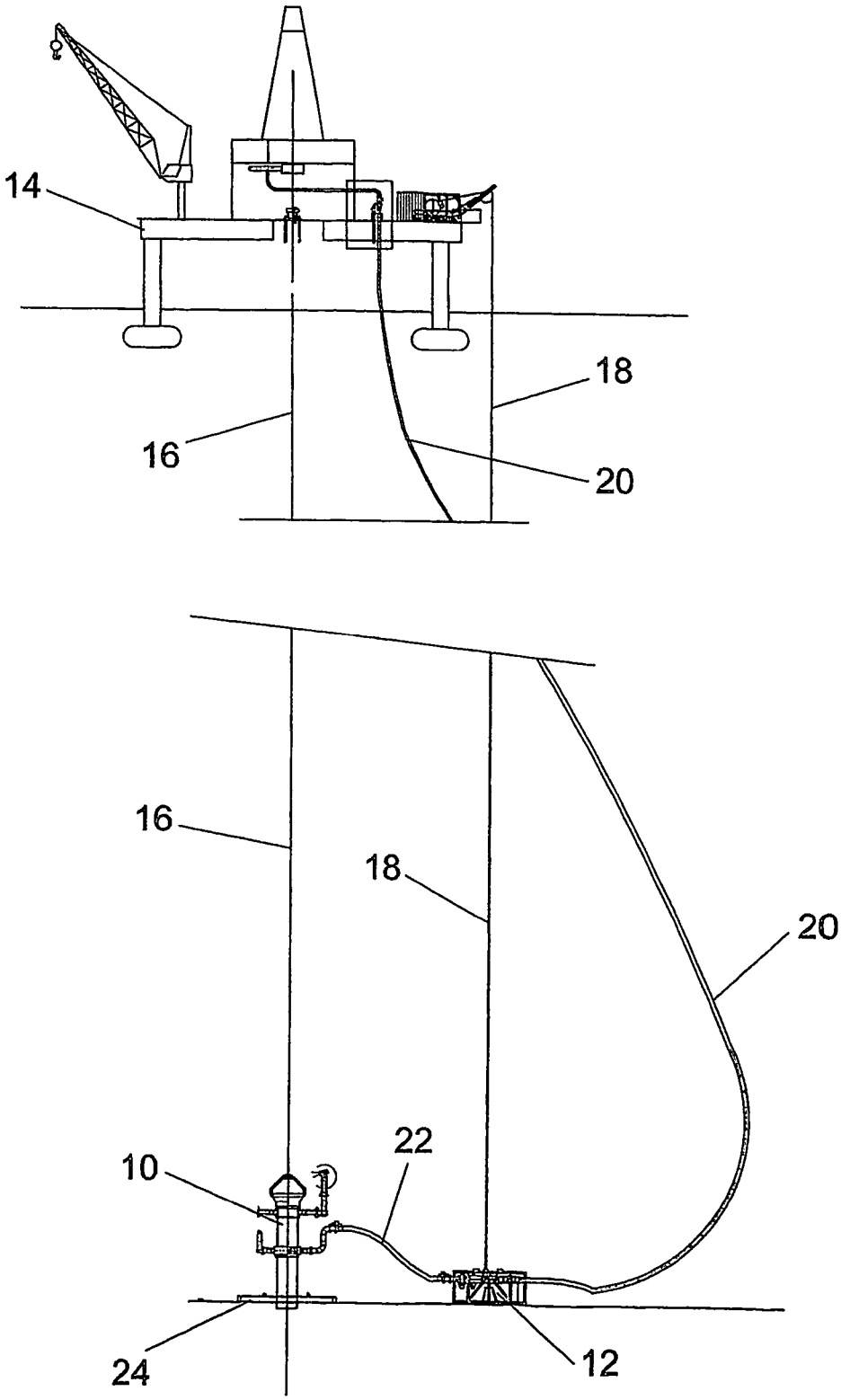
FIG. 1 shows an example of a system with floating drilling rig and a suction module and a pump arranged on the ocean bottom.

FIG. 1 shows an example of a system which uses a device according to the invention. In the example shown in FIG. 1, the rig is not shown to scale in relation to the equipment placed on the ocean bottom.

Top hole drilling is carried out at the start of drilling a bore hole, and is carried out before blow-out protection (BOP) is fitted on a wellhead and a riser is mounted between the rig and the bore hole. As FIG. 1 shows, a floating drilling rig 14 is placed above the bore hole on the ocean bottom, from where a drill stem 16 extends from the floating drilling rig 14 down to the bore hole and which runs through a suction module 10 according to the invention. That a floating drilling rig is shown is only as an example, a floating drilling vessel or a drilling rig which stands on the ocean bottom can also be used.

As mentioned, FIG. 1 shows the suction module 10 according to the invention, where a pipe or pipeline 22 for transport of drilling fluid that comes in return from the well which is being drilled extends from an outlet on the suction module to a pump module 12 that is arranged separately from the mentioned suction module. A cable extends between the drilling rig 14 and the pump module for lowering and hoisting of the pump module and also for the supply of power to the pump engine and any other drive units, and also for control signals. In the example shown, a return pipe 20 for drilling fluid extends from the pump module 12 to the drilling rig 14. The drilling rig can comprise equipment for recovery of the return drilling fluid so that recovered drilling fluid can be used during drilling of the same well or another well which is being drilled or is to be drilled. The equipment for recovery of drilling fluid is known by people skilled in the arts and will therefore not be described in more detail in this application. In the examples shown, the suction module and the pump module are shown arranged separately from each other on the ocean bottom, but alternatively can also be integrated with each other to make up one unit. Another embodiment can be that the pump module hangs a distance above the ocean bottom, for example, in that it hangs in the pump return pipe.

Figure 2:
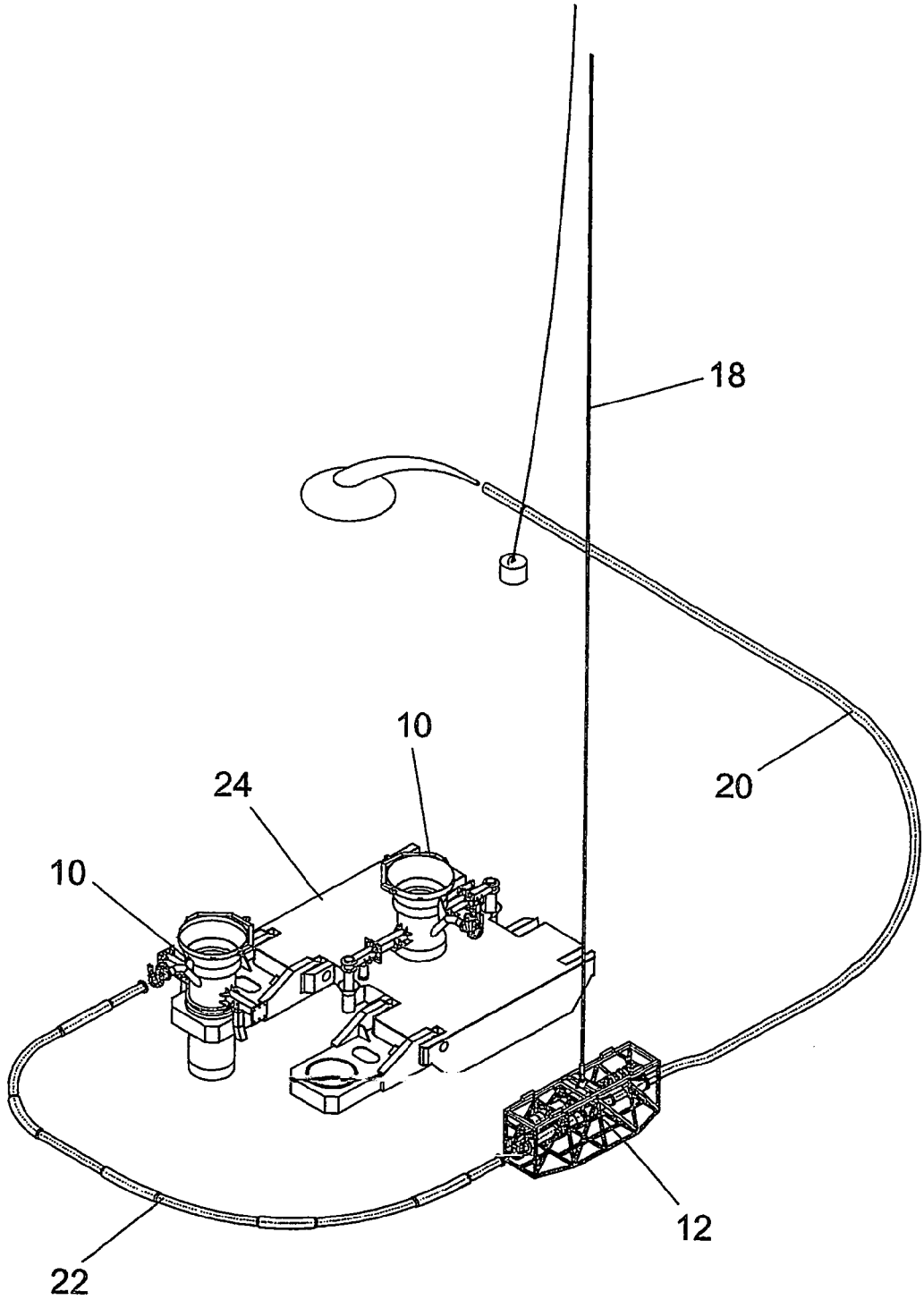
FIG. 2 shows a template with several suction modules connected to a pump, and also associated pipes.

FIG. 2 shows another example of a system with a suction module 10 according to the present invention. The system primarily comprises the same main components as shown in FIG. 1, apart from that the return pipe 20 does not extend up to the drilling rig 14, but to another location on the ocean bottom to deposit return drilling fluid onto the ocean bottom. The aim of depositing return drilling fluid at another location on the ocean bottom is, among other things, to improve visibility for ROV (remote controlled submarine vessel), visibility for monitoring equipment, reduce the pollution around the template etc. There is also a requirement from the authorities to reduce the pollution on the ocean bottom in connection with drilling of wells. Of course, the same objectives will be relevant for the system shown in FIG. 1.

As shown in FIG. 2, a template 24 is placed on the ocean bottom. In the example shown there are three openings and two suction modules 10 according to the invention. Of course, there can be more or fewer openings and suction modules. The pipeline 22 for return drilling fluid extends from the suction module to the pump module 12 and, as mentioned, the return pipe 20 extends from the pump 12.

Figure 3:
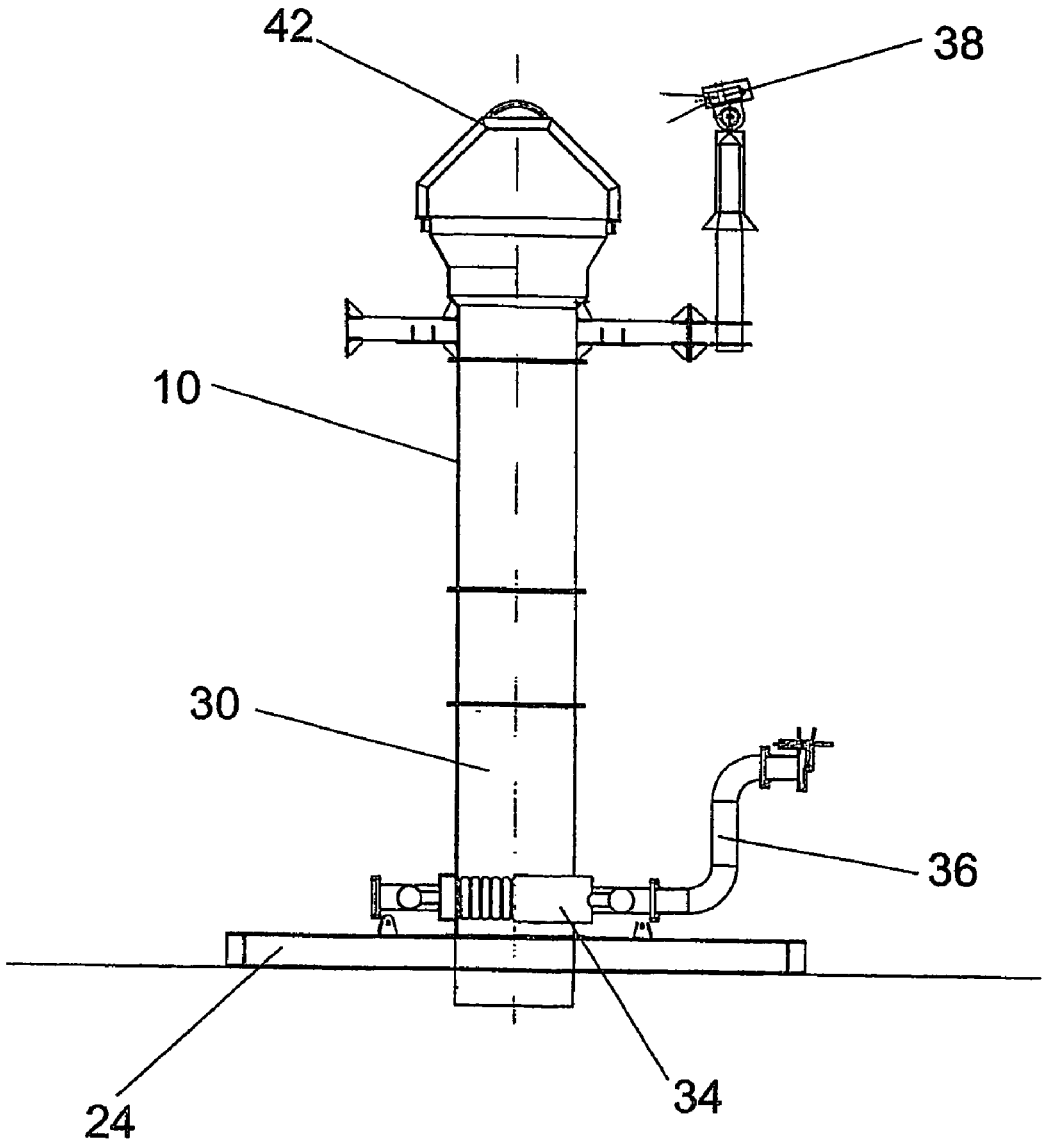
FIG. 3 shows an embodiment example of a suction module with a device according to the present invention.

The invention comprises a suction module 10 placed on a template 24, where the template comprises downwardly extending elements or skirts for anchoring to the ocean bottom. The suction module further comprises an extended pipe-formed body 30, where the body 30 can be composed of one or more modules. FIG. 3 shows a suction module with several extension modules, while FIG. 4 shows a suction module without such extension modules. The aim of the extension modules is, among other things, to make it possible to regulate the level/volume of amount of return drilling fluid which is in the pipe-formed body 30. The pipe-formed body is arranged to an ocean-bottom penetrating pipe, such as a casing, and is preferably open at the top and the bottom.

The pipe-formed body 30 comprises at least one outlet passage 32. With more than one outlet passage, the outlet passages are preferably arranged radially and with mutual distance apart around the pipe wall of the pipe-formed body. Preferably arranged to the outlet passage(s) 32 is a suction manifold 34, which can have one or more outlets 36 with suction connections for the pump. As mentioned, the pipeline 22 is arranged between the suction connection and the pump module. The suction manifold 34 is not required for the realization of the invention, but is preferably used if there are several outlet passages 32 and/or several outlet/suction connections 36.

The suction module 10 also comprises monitoring equipment for the monitoring of the level of return drilling fluid in the pipe-formed body 30. For example, this can be a camera 38, a sonar, or similar equipment. Measuring equipment can also be arranged internally in the pipe-formed body to measure the weight and thus the height of the fluid column that stands in the body.

As mentioned, the present invention relates to a device for removal of drilling fluid in top hole drilling, where a suction module 10 comprises an extended pipe-formed body 30 which is open at the top and is arranged to an ocean-bottom penetrating pipe, through which a drill stem 16 is led for drilling of the top hole, and where the pipe-formed body 30 comprises at least one outlet passage 32 in the pipe wall for export of return drilling fluid from the bore hole to the pump module 12. To prevent that the suction pipeline 22 is blocked during drilling in swelling clay, the suction module 10 according to the invention is equipped with a filtration device with through openings that prevent large particles from entering the pump and damaging or possibly blocking it. For example, this can be obtained by the pipe-formed body 30 comprising an inner extended and arched perforated filtration plate 40, where the perforations of the inner filtration plate are arranged to let through, to at least one outlet passage 32, return drilling fluid containing disperse material, such as swelling clay and stones, of a size which is less than the diameter of the inlet pipe of the pump or the openings of the pump. Furthermore, the inner pipe wall of the pipe-formed body 30 and the inner perforated filtration plate 40 provide at least one annular space that is closed at the top and/or bottom, where the annular space can extend in the whole or parts of the longitudinal direction of the pipe-formed body and/or in the pipe circumference. The perforated filtration plate 40 can preferably have a pipe shape.

The filtration device according to the invention can also be formed in other ways than described above. For example, an inner body with a grid-form, bar-form, etc, that is arranged to prevent particles of a certain size from passing through suitable openings, can be used. Other types of filtration devices can also be relevant, for example, a cyclone separator can be adapted for use in the suction module, arranged so that particles above a certain size are led up in the pipe-formed body, and that particles below a certain size are led to the outlet passage(s). The cyclone separator can also be arranged in the pipe-formed body, and/or be incorporated in connection with the mentioned annular space in the pipe-formed body.

The invention claimed is:

1. An apparatus for removal and filtration of drilling fluid during top hole drilling, wherein a suction module (10) comprises an elongated pipe-formed body (30), which is open at the top and is arranged to an ocean-bottom penetrating pipe, through which is led a drill stem for drilling of the top hole, and the pipe-formed body (30) comprises a filtration device with through openings, where said openings are arranged to let through to at least one outlet passage (32) in the pipe wall, filtered return drilling fluid containing dispersed material, such as swelling clay or stones, wherein filtered return drilling fluid from the bore hole is exported to a pump module (12) through the at least one outlet passage (32) in the pipe wall, the material in the drilling fluid being of a size less than the diameter of a inlet pipe of the pump or openings of the pump, the upper part of the pipe-formed body (30) is arranged to contain return drilling fluid, which is not fed to the pump module (12), and where a volume of said drilling fluid stands as a "plug" above the outlet (32) of the suction pipe (22) of the pump and is sealed against the drill stem (l6), and the level of return drilling fluid in the pipe-formed body (30) being adjusted by regulation of the capacity of the pump (12).

2. The apparatus according to claim 1, wherein the suction module (10) comprises a camera (38) and/or a sonar for monitoring of the level of the drilling fluid, including the "plug" of return drilling fluid, in the pipe-formed body (30), and that monitoring signals are sent to an operator for regulation of the capacity of the pump (12).

3. The apparatus according to claim 1, wherein the suction module (10) comprises measuring equipment for monitoring of the level of drilling fluid, including the "plug" of return drilling fluid, in the pipe-formed body (30), and that monitoring signals are sent to an operator, or directly to the pump (12) for regulation of the capacity of the pump.

4. The apparatus according to claim 1, wherein the filtration device comprises an inner, elongated and arched, perforated filtration plate (40) where at least one annular space, or parts of an annular space that is closed at the top and/or at the bottom, is provided between the inner pipe wall of the pipe-formed body (30) and the inner perforated filtration plate (40).

5. The apparatus according to claim 4, wherein the annular space extends in the whole, or parts, of the longitudinal direction of the pipe-formed body (30) and/or its circumference.

6. The apparatus according to claim 4, wherein the elongated, perforated filtration plate (40) is formed in the shape of a pipe.

7. The apparatus according to claim 1, wherein the pipe wall of the pipe-formed body (30) comprises a number of outlet passages (32) arranged spaced apart radially around the pipe wall, where the outlet passages (32) are connected to the suction pipe (22) of the pump (12).

8. The apparatus according to claim 7, wherein at least one of the outlet passages (32) in said pipe wall is connected to a suction manifold (34), and that the suction pipe (22) of the pump is connected to the suction manifold (34).

9. The apparatus according to claim 8, wherein the suction manifold (34) comprises a number of outlets with suction connection for the pump (12).

10. The apparatus according to claim 1, wherein the suction module (10) comprises a lifting loop (42), or another appliance for connection of a lifting tool.

11. The apparatus according to claim 1, wherein the suction module (10) and the pump module (12) are integrated with each other.

12. The apparatus according to claim 2, wherein the suction module (10) comprises measuring equipment for monitoring of the level of drilling fluid, including the "plug" of return drilling fluid, in the pipe-formed body (30), and that monitoring signals are sent to an operator, or directly to the pump (12) for regulation of the capacity of the pump.

13. The apparatus according to claim 3, wherein the filtration device comprises an inner, elongated and arched, perforated filtration plate (40) where at least one annular space, or parts of an annular space that is closed at the top and/or at the bottom, is provided between the inner pipe wall of the pipe-formed body (30) and the inner perforated filtration plate (40).

14. The apparatus according to claim 5, wherein the elongated, perforated filtration plate (40) is formed in the shape of a pipe.

15. The apparatus according to claim 5, wherein the pipe wall of the pipe-formed body (30) comprises a number of outlet passages (32) arranged spaced apart radially around the pipe wall, where the outlet passages (32) are connected to the suction pipe (22) of the pump (12).

16. The apparatus according to claim 6, wherein the pipe wall of the pipe-formed body (30) comprises a number of outlet passages (32) arranged spaced apart radially around the pipe wall, where the outlet passages (32) are connected to the suction pipe (22) of the pump (12).

17. The apparatus according to claim 4, wherein the suction module (10) comprises a lifting loop (42), or another appliance for connection of a lifting tool.

18. The apparatus according to claim 7, wherein the suction module (10) comprises a lifting loop (42), or another appliance for connection of a lifting tool.

19. The apparatus according to claim 10, wherein the suction module (10) and the pump module (12) are integrated with each other.

* * * * *